United States Patent [19]

Sakuma et al.

[11] 4,431,885

[45] Feb. 14, 1984

[54] VACUUM INTERRUPTER

[75] Inventors: Shinzo Sakuma, Kawasaki; Junichi Warabi, Shizuoka; Yutaka Kashimoto, Tokyo, all of Japan

[73] Assignee: Kabushiki Kaisha Meidensha, Tokyo, Japan

[21] Appl. No.: 318,553

[22] Filed: Nov. 5, 1981

[30] Foreign Application Priority Data

Nov. 5, 1980 [JP] Japan ..... 55-157957[U]

[51] Int. Cl.[3] ..... H01H 33/66

[52] U.S. Cl. ..... 200/144 B

[58] Field of Search ..... 200/144 B

[56] References Cited

U.S. PATENT DOCUMENTS 3,727,018 4/1973 Wesoloski et al. ..... 200/144 B

FOREIGN PATENT DOCUMENTS 2014739 10/1971 Fed. Rep. of Germany ... 200/144 B
80087 11/1971 Fed. Rep. of Germany .
2440827 3/1976 Fed. Rep. of Germany ... 200/144 B
2440829 3/1976 Fed. Rep. of Germany ... 200/144 B
134693 3/1979 Fed. Rep. of Germany .
56-149731 11/1981 Japan ..... 200/144 B
1030798 5/1966 United Kingdom ..... 200/144 B
1410802 10/1975 United Kingdom ..... 200/144 B

*Primary Examiner*—Robert S. Macon
*Attorney, Agent, or Firm*—Lowe, King, Price & Becker

[57] ABSTRACT

A vacuum interrupter comprises a vacuum vessel 3, a pair of electrodes 4, 5 disposed within the vacuum vessel 3 so that one is in contact with the other or away therefrom, and a bellows 17 for allowing a movable electrode 5 to be movable with an air-tight relationship. The vacuum interrupter further comprises an auxiliary member 21 disposed between the bellows 17 and the vacuum vessel 3, thereby making it easy to effect the positioning of the bellows 17 and a brazing material. The auxiliary member 21 further serves as a member for absorbing and relaxing an impact appearing at the bellows when the vacuum interrupter is placed in an operational condition.

3 Claims, 3 Drawing Figures

VACUUM INTERRUPTER

BACKGROUND OF THE INVENTION

The present invention relates to a vacuum interrupter, and more particularly to a vacuum interrupter wherein a bellows maintains air-tightness of a vacuum vessel.

Generally, a vacuum interrupter comprises a pair of electrical contacts disposed so that one is in contact with the other or away therefrom through a pair of contact rods extending into a vacuum vessel so that one is close to the other or away therefrom. To move the contact rod positioned on a movable side while maintaining air-tightness within the vacuum vessel, the vacuum interrupter further comprises a bellows, one end of which is hermetically joined to the movable contact rod while the other end is hermetically joined to the vacuum vessel.

However, when each member constituting the above interrupter is provisionally assembled under the condition that brazing material is interposed therebetween, the following drawbacks are pointed out:

First, it is difficult to effect positioning of the bellows in both axial and radial directions with respect to the vacuum vessel.

Second, it is difficult to effect positioning of the brazing material interposed between the bellows and the vacuum vessel.

Specifically, where the vacuum vessel comprises a metallic casing member and an insulating end plate fastened to the opening end of the metallic casing member, elimination of the above mentioned drawbacks is required.

That is, the insulating end plate is provided with a bore in the center thereof, and metallized layers provided on the side of inner radius and on the side of outer radius. Assuming that the insulating end plate is directly connected to the metallic casing member. In order to increase a mechanical strength therebetween and an air-tightness, it is preferable that the layer positioned on the side of outer radius is provided with a stepped portion. However, two working steps for grinding thereto are required. Futher, when assembling, if a bellows is directly mounted on the layer positioned on the side of inner radius, it is difficult to obtain a satisfactory accuracy of dimension because of thin thickness of the bellows.

SUMMARY OF THE INVENTION

With the above in mind, an object of the present invention is to provide a vacuum interrupter making it easy to effect the positioning of the bellows and the brazing material in the axial and radial directions at the time of provisional assembly.

Another object of the present invention is to provide a vacuum interrupter making it possible to absorb and relax an impact appearing in the axial and radial directions of the bellows when the vacuum interrupter thus constructed is operational condition.

BRIEF DESCRIPTION OF THE DRAWINGS

The features and advantages of a vacuum interrupter according to the present invention will become more apparent from the following description taken in conjunction with the accompanying drawings, in which.

DETAILED DESCRIPTION OF THE PREFERRED EMBODIMENT

Figure 1:
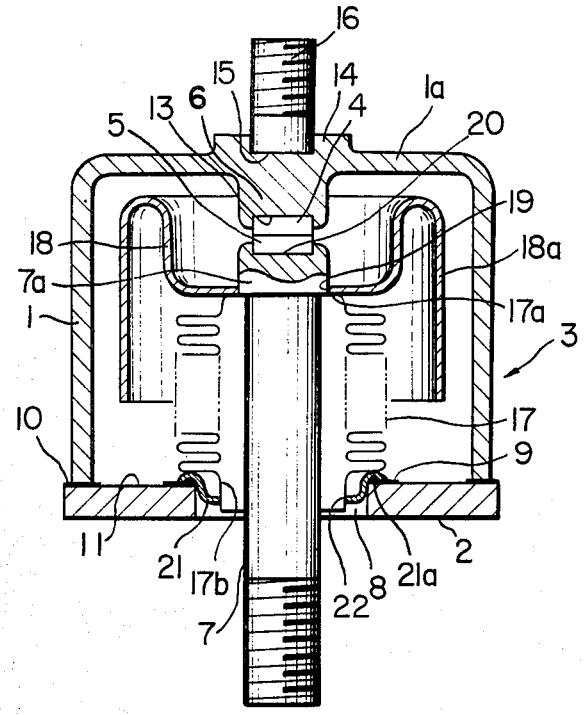
FIG. 1 is a longitudinal cross sectional view illustrating a vacuum interrupter according to the present invention.

A vacuum interrupter according to the present invention comprises a vacuum vessel 3 constituted by hermetically enclosing the opening end of a bell shaped metallic casing member 1 with a disk plate 2 of inorganic insulating material and evacuating the interior thereof to high vacuum. A pair of electrical contacts 4 and 5 provided respectively within vacuum vessel 3 on a stationary electrical contact mounting portion 6 and a movable contact rod introduced from the center of the bottom portion of the metallic casing member 1 and the center of the insulating disk plate 2, respectively, in a relative manner.

The insulating disk plate 2 is made of inorganic insulating material, such as alumina ceramics. The insulating disk plate 2 is provided at the center thereof with a bore 8 extending in the axial direction (in the upper and lower directions in FIG. 1), and is provided thereon on the side of inner radius thereof and on the side of outer radius thereof with metallized layers 9 and 10 of metal, such as Mo-Mn-Ti alloy or Mn-Ti alloy of which coefficient of theremal expansion is substantially the same as that of alumina ceramics.

When forming metallized layers 9 and 10, grinding thereto is usually effected. To facilitate grinding, there is provided an annular groove having a depth of 0.1 mm to 0.5 mm between metallized layers 9 and 10 provided on insulating disk plate 2 concentrically with bore 8. The metallic casing member 1 is hermetically joined to the insulating disk plate 2 by hermetically brazing the end surface of the opening end portion to the metallized layer 10 provided along the outer periphery thereof. The metallic casing member 1 is made of copper which thickness thereof is relatively large in order to increase mechanical strength.

The metallic casing member 1 is provided in the center of the inner surface (inner bottom surface) of the portion 1*a* integrally with an electrode mounting portion 6 serving as the stationary contact rod so that it projects.

The electrical contact 4 is fitted into a recess 13 provided at the axially extended end of the electrode mounting portion 6 in such a manner that it projects therefrom by a suitable distance, and is brazed thereto. The metallic casing member 1 is further provided in the center of external surface (external bottom surface) of a bottom portion 1*a* of the casing member 1 with an electrically collecting annular portion 14 so that it projects.

The bottom portion 15 of a steel bolt 16 which constitutes the stationary contact rod together with the electrode mounting portion 6 and the electrically collecting portion 14 is fitted into a recess provided in the electrically collecting portion 14, .and is fixed thereto by means of a brazing material. The vacuum interrupter is fixed to a supporting member (not shown) with bolt 16, and is electrically connected to other equipment.

Within vacuum vessel 3, a bellows 17 of austenite stainless steel is concentrically accommodated. Bellows 17 is provided at one end thereof with a joined portion 17*a*. Movable contact rod 7 is inserted into the vacuum vessel 3 through the bore 8 provided in insulating disk plate 2 and the opening provided in joined portion 17*a* of bellows 17. The movable contact rod 7 is provided at the upper portion thereof with a radially enlarged top portion 7*a*. The movable contact rod 7 is hermetically joined to bellows 17 so that the stepped portion of the radially enlarged top portion 7*a* is brazed to the joined portion 17*a*.

The movable contact rod 7 is made of copper or copper alloy. A cup-shaped shield member 18 made of the same metal as that of the bellows 17 is fitted over the movable contact rod 7 through a bore 19 provided in the center thereof and is brazed thereto in such a manner that an inner bottom portion thereof is in contact with the joined portion 17*a*. The shield member 18 is integrally formed with a bellows protecting portion 18*a*.

The bellows protecting portion 18*a* is formed by bending the opening peripheral edge thereof outwardly and extending in the direction of the insulating disk plate 2 so as to protect that metallic vapour is attached to the surface of the bellows 18. The movable contact rod 7 is provided at the inwardly extended top portion 7*a* with a recess 20. An electrical contact 5 is fitted into the recess 20 so that it projects by a suitable distance, and is fixed thereto by brazing. The bellows 17 is at the end portion thereof integrally formed with a tubular portion 17*b* extending in the axial direction. The tubular portion 17*b* is fitted into the bore 8 provided in the insulating disk plate 2. An auxiliary member 21 is fitted to tubular portion 17*b* through a bore 22 provided in the bottom center thereof, and is joined thereto in such a manner that the outer peripheral surface of the tubular portion 17*b* is hermetically brazed to the peripheral surface of the bore 22.

The coefficient of thermal expansion of auxiliary member 21 is smaller than that of bellows 17 of austenite stainless steel, and is similar to that of the insulating disk plate 2 of alumina ceramics.

Figure 2:
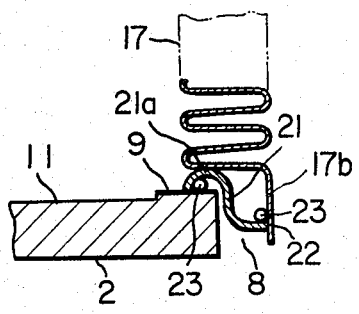
FIG. 2 is a cross sectional view illustrating an auxiliary member employed in the vacuum interrupter shown in FIG. 1.

The auxiliary member 21 is made of Fe-Ni-Co alloy or Fe-Ni alloy, having a coeffecient of thermal expansion similar to that of alumina ceramics. The outer radius of the opening portion thereof is suitably larger than a diameter of the bore 8. The auxiliary member 21 is formd to be S-shaped, and is integrally formed with an arcuate portion 21*a* as shown in FIGS. 1 and 2. The auxiliary member 21 is hermetically brazed to the metallized layer 9 of insulating disk plate 2 through a peripheral end surface of arcuate portion 21*a* under the condition that the wave portion provided at the outer peripheral portion of the bellows 17 is in contact with the top portion of arcuate portion 21*a*.

Figure 3:
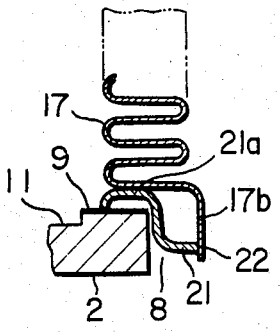
FIG. 3 is a cross sectional view illustrating a modification of the auxiliary member shown in FIG. 2.

It is not necessary that auxiliary member 21 be made of Fe-Ni-Co alloy or Fe-Ni alloy. For instance, auxiliary member 21 may be made of Fe or Cu. Also, in the illustrated embodiment, auxiliary member 21 appears S-shaped in cross section. However, the shape thereof is not limited to the above mentioned structure. For instance, as shown in FIG. 3, the auxiliary member 21 may be formed so that the cross section thereof is substantially crank-shaped.

The above mentioned structure that the insulating disk plate 2 is hermetically brazed to the bellows 17 through the auxiliary member 21 makes it possible to precisely effect the positioning of bellows 17 in the axial and radial direction with respect to insulating disk plate 2 at the time of provisional assembly Also, as shown in FIG. 2, this structure makes it possible to precisely position by fitting a tubular portion 17*b* of the bellows 17 into the circumference of the bore 22 provided in the auxiliary member 21 and mounting a brazing material 23 thereon.

It is unnecessary to adjust the clearance between the bellows 17 and the auxiliary member 21, and between the auxiliary member 21 and the insulating disk plate 2 at the time of brazing in the atmosphere of vacuum.

An impact applied to the bellows 17 when the vacuum interrupter thus constructed is placed in operative condition is effectively absorbed and relaxed in the axial and radial directions since the auxiliary member 21 is substantially S-shaped in cross section. Further, the wave portion of the outermost end of the bellows 17 is in touch with arcuate portion 21*a*, thereby making it possible to restrict the movement of the portion where there is possibility that there occurs fatigue or breakage. Thus, the life time of the bellows 17 can be improved.

In the abovementioned embodiment, the vacuum vessel 3 comprises metallic cup-shaped casing member 1 and disk-shaped insulating end plate 2 attached to the opening end of the casing member 1. On the basis of this structure, it is seen that the object of the present invention can be achieved.

Furthermore, it is not limited that the bellows is not accommodated within the vacuum vessel. For instance, the bellows may be provided outside of the vacuum vessel.

It is to be understood that modification and variations of the embodiments of the present invention disclosed herein may be resorted to without departing from the spirit of the invention and the scope of the appended claims.

What is claimed is:

1. A vacuum interrupter comprising a pair of stationary and movable electrical contacts provided within a vacuum vessel enclosed by an insulating end plate having a bore in the center thereof, a movable contact rod for actuating the movable electrical contact relative to the stationary electrical contact so that the stationary and movable contacts are engageable with each other, and a cup-shaped cylindrical bellows having a first end operatively joined to the moveable contact rod and a second end connected to the insulating end plate of the vacuum vessel, the bellows being provided at the second end thereof with a tubular portion, the improvement comprising an auxiliary member functioning as a vacuum-tight member adapted to be interposed between and hermetically brazed to the bellows and the end plate, said auxiliary member comprising an integral arcuate portion and a bottom portion having a center bore, an outer periphery of said tubular portion of the bellows being fitted into said bore in said auxiliary member, wherein one end of said auxiliary member is hermetically connected to an inner end surface of the end plate, the other end of said auxiliary member extending towards the center of the bore in the end plate and being hermetically connected to the outer periphery of the tubular portion of said bellows, said bellows further including a wave portion integral with the tubular portion thereof, the wave portion being mounted to contact the inner surface of said arcuate portion to define a closed space or cavity between the inner surface of said auxiliary member and the outer surface of the tubular portion, said auxiliary member effecting precise positioning of the bellows in radial and axial directions of the end plate during assembly of the interrupter, contact between the wave portion and arcuate portion restricting movement of the arcuate portion to prevent breakage of the bellows and reduce fatigue therein.

2. A vacuum interrupter as defined in claim 1, wherein said auxiliary member is S-shaped in cross section.

3. A vacuum interrupter as defined in claim 1, wherein said auxiliary member is crank-shaped in cross section.

* * * * *